United States Patent [19]

Bertocchio et al.

[11] 4,069,158

[45] Jan. 17, 1978

[54] FIRE EXTINGUISHING COMPOSITIONS

[75] Inventors: Reńe Bertocchio, Vernaisson; Louis Foulletier, Oullins, both of France

[73] Assignee: Produits Chimiques Ugine Kuhlmann, Paris, France

[21] Appl. No.: 678,929

[22] Filed: Apr. 21, 1976

[30] Foreign Application Priority Data

Apr. 25, 1975 France ..... 75 12981

[51] Int. Cl.[2] ..... A62C 1/00; B01F 17/30

[52] U.S. Cl. ..... 252/3; 252/8.05; 252/356

[58] Field of Search ..... 252/3, 8.05, 356; 21/60.5 A

[56] References Cited

U.S. PATENT DOCUMENTS

| | | | |
|---|---|---|---|
| 3,257,407 | 6/1966 | Brace | 252/8.05 |
| 3,258,423 | 6/1966 | Tuve et al. | 252/3 |
| 3,772,195 | 11/1973 | Francen | 252/3 |
| 3,941,705 | 3/1976 | Foulletier et al. | 252/8.05 |

*Primary Examiner*—Benjamin R. Padgett
*Assistant Examiner*—Josephine Lloyd
*Attorney, Agent, or Firm*—Pennie & Edmonds

[57] ABSTRACT

Aqueous fire-extinguishing compositions comprising a mixture of (1) a nonionic surface-active agent, (2) a amphoteric surface active agent and (3) a fluorinated cationic surface active agent containing as a part of the molecule an aromatic radical.

12 Claims, No Drawings

FIRE EXTINGUISHING COMPOSITIONS

BACKGROUND OF THE INVENTION

French Pat. No. 2,185,668 discloses that aqueous compositions possessing a high spreading velocity over hydrocarbons may be obtained by combining:

a. an amphoteric fluorinated surface-active compound, b. a nonionic fluorinated surface-active compound, c. a salt of a polyfluorinated acid and a diamino hydrocarbon.

However, the films obtained from such compositions according to the well-known "light water" principle were too fragile. To form stable films it was necessary to quaternize the free amino group of the third component by means of a lactone, thereby converting it into another salt having the following formula:

$$C_nF_{2n+1}(CH_2)_aCOO^- NH_2{}^+R_1-(CH_2)_pN^{30}(R_2R_3)(CH_2)_qCOO^-$$

This function as a spreading agent has also been recognized in U.S. Pat. No. 3,661,766, in which an amphoteric fluorinated surface-active compound and a salt of a polyfluoro acid are combined.

It has been unexpectedly discovered that cationic fluorinated surface-active compounds which contain at least one aromatic ring in their molecule leads to the same results, while improving to a considerable degreee the spreading velocity of the composition over liquid hydrocarbons in general, and more particularly over those containing aromatic constituents such as gasolines.

There are several types of fire-extinguishing compositions which comprise mixtures of fluorinated surfactants and hydrocarbon sufactants, notably of the cationic type. In British Pat. No. 1,280,508, the possible use of nonfluorinated aromatic quaternary ammonium salts is envisaged solely from the point of view of their bactericidal action; moreover, this application is designed for mixtures of protein hydrolyzates and fluorinated sufactants. Nonfluorinated quaternary ammonium salts are used also in Australian Pat. No. 262,897 with a view to obtaining foaming compositions. Other mixtures, as described in U.S. Pat. No. 3,258,423, combine amphoteric and cationic fluorinated, but the resulting films tear and readily retract under the effect of mechanical stresses, and their spreading velocity is not too high, particularly in the case of hydrocarbons of low surface tension such as gasolines.

SUMMARY OF THE DISCLOSURE

The invention relates to compositions containing cationic fluorinated surface-active compounds which contain at least one aromatic ring or radical in their molecules and particularly to compositions containing cationic fluorinated surface active compounds in combination with a fluorinated amphoteric surface active compound and a nonionic surface active compound useful as fire extinguishing compositions.

DETAILED DESCRIPTION OF THE INVENTION

The new compounds which may be used as spreading agents are fluorinated cationic surface-active compounds comprising at least one aromatic ring or radical in their molecule. The term "aromatic" is used herein in the broad meaning of the term and includes all cyclic rings containing a conjugated electron system, including aromatic compounds such as benzene, pyridine, napthalene, furanes, thiofuranes rings, etc. and their derivatives. The novel, preferred fire-extinguishing compositions of the present invention comprises a combination of:

a. an amphoteric fluorocarbon surfactant of formula $$C_nF_{2n+1}-(CH_2)_aX-\underset{\underset{R_1}{|}}{N}(CH_2)_p\overset{+}{N}\begin{matrix}R_2\\R_3\end{matrix}(CH_2)_qCOO^- \qquad \text{I}$$

b. a nonionic fluorocarbon surfactant of formula $$C_nF_{2n+1}(CH_2)_a-(Y)_b(O-C_2H_4)_mOR_4 \qquad \text{II}$$

c. a cationic fluorocarbon surfactant of formula $$\left[C_nF_{2n+1}-CH_2-CH_2-N\begin{matrix}R'\\R''\\R'''\end{matrix}\right]^+A^- \qquad \text{III}$$

The amphoteric fluorinated of formula (I) which may be used according to the invention are products described in French Pat. Nos. 2,127,287 and 2,088,941. They have the following general formula:

$$C_nF_{2n+1}-(CH_2)_a-X-\underset{\underset{R_1}{|}}{N}(CH_2)_p\overset{+}{N}\begin{matrix}R_2\\R_3\end{matrix}(CH_2)_qCOO^-$$

in which $C_nF_{2n+1}$ represents a straight or branched perfluoro chain where $n$ is a whole number between 1 and about 20; $a$ is a whole number between 2 and 10; X represents a functional group, either CO or $SO_2$; $R_1$ is a hydrogen atom or an alkyl radical containing 1 to 6 carbon atoms; $R_2$ and $R_3$ are alkyl radicals containing 1 to 3 carbon atoms, with at least one of these radicals being methyl; p and q are numbers between 1 and about 10.

The nonionic flurocarbon (II) are products having the general formula $$C_nF_{2n+1}-(CH_2)_a-(Y)_b-(OCH_2-CH_2)_mOR_4$$

in which $n$ and $a$ have the same meaning as above; Y represents the CO group; $b$ is a number equal to 1 or 0; $m$ is a whole number between 1 and about 20; $R_4$ is a hydrogen atom or an alkyl radical containing 1 to 6 carbon atoms in the case where $b = 1$.

When $b = 1$, these compounds are prepared by esterification of the acids $C_nF_{2n+1}-(CH_2)_a-COOH$ by means of $w$-alkyl polyethoxy alcohols of the general formula $HO(CH_2-CH_2-O)_m-R_4$.

In the other case they are obtained by polyethoxylation of the alcohols $C_nF_{2n+1}-(CH_2)_aOH$.

The compounds of formula III are described in French Pat. No. 1,588,482 and British Pat. No. 1,269,095.

$$\left[C_nF_{2n+1}-CH_2-CH_2-N\begin{matrix}R'\\R''\\R'''\end{matrix}\right]^+A^-$$

In this formula: $C_nF_{2n+1}$ represents a straight or branched perfluoro chain where $n$ is a whole number between 1 and about 20. A is an anion such as a halide, sulfate, alkylsulfonate, arylsulfonate, phosphate, acetate, hydroxyl; R′, R″, and R‴, are defined as follows:

1. R′ and R″ may be identical or different, and are alkyl radicals containing 1 to 8 carbon atoms. In this Case R‴ is an aryl radical or an arylalkyl radical containing 1 to 8 carbon atoms in the alkyl chain, or the aromatic derivative of a hydroxyalkyl radical containing between 1 and about 8 carbon atoms;
2. R′ is an alkyl radical containing 1 to 8 carbon atoms, and R″ and R‴ together constitute a divalent radical linked to the nitrogen atom by two single bonds derived from alkyl, alkenyl or dienic groups such as cycloalkyl, cycloalkenyl or cyclodienic radicals containing 4 to 9 atoms and carrying or containing aromatic substituents or radical;
3. R′, R″ and R‴ together constitute the residual part of a tertiary aromatic amine derived from pyridine or pyridine derivatives and containing 5 to 18 carbon atoms. Preferred among these residual parts of tertiary aromatic amines are those derived from $C_5H_5$ (pyridine), $C_9H_7$ (quinoline and isoquinoline), $C_6H_8$ (picolines) or $C_{13}H_9$ (acridine).

Some specific examples of cationic surface active agents coming within the scope of the above formula include:

A) 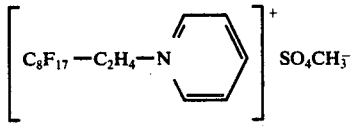

B) 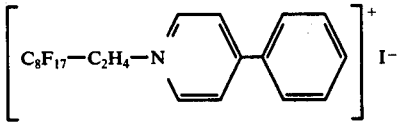

C) 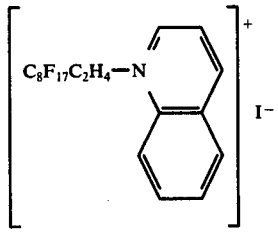

D) 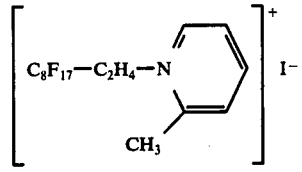

E) 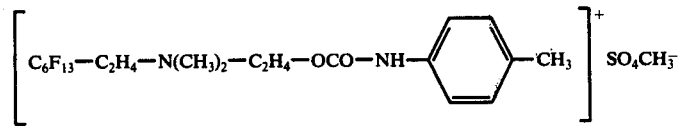

F) 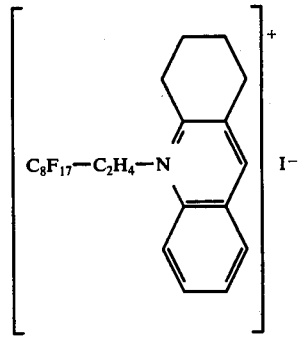

A particularly effective compound for this type of application is N-heptadecafluoro-tetrahydrodecylpyridinium tosylate G) 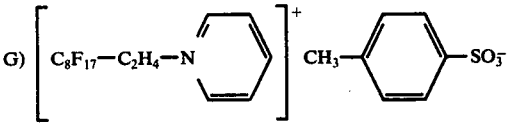

The cationic surface active agents according to formula III can be prepared in the manner set forth in French Pat. No. 1,588,482 and British Pat. No. 1,269,095. The aromatic derivative of the hydroxyalkyl radicals can be prepared in known manners also described in the above patents. For example, the hydroxy alkyl such as XROH where X is iodine or bromine and R is the alkyl radical can be reacted with a fluorinated tertiary amine such as

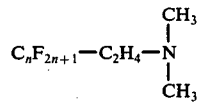

to produce the hydroxy derivative and the hydroxy derivative is reacted with an aromatic containing compound such as toluene isocyanate to produce the aromatic derivative of a hydroxyalkyl radical. An aromatic containing compound could also be reacted with a alkyl hydroxy compound such as XROH above, for example toluene isocyanate, to produce the hydroxyalkyl aromatic derivative which can be subsequently reacted with a tertiary amine as noted above to produce R''' as an aromatic derivative of a hydroxyalkyl radical.

When used by themselves these fluorinated cationic compounds do not have a permanent film-forming ability and their spreading velocity can only be utilized by combining them, in a preferred proportion of 30 to 60% by weight, based on the weight of the total surface active agents, with one or several surface-active compounds capable of providing firm films. Such compounds generally belong to the class of amphoteric fluorinated surface-active agents, which are combined with a nonionic surfactant with a view to endowing the mixture with the visco properties necessary for achieving a greater ease of dissolution and conversion into foam.

The use of a fluorinated nonionic surface-active agent has the advantage that it leads in certain cases to a decrease of the surface tension of the mixture, hence to an increase of the value of the coefficient of spreading, as has been stated by the Applicant in French Patent 2,185,668.

Table I gives an illustration of the respective functions of the cationic component and the amphoteric component in the type of combination above.

in the absence of the film, measured under identical experimental conditions.

$$PF_t = \frac{\text{Rate of Evaporation in presence of fluorinated film}}{\text{Rate of evaporation of the solvent}}$$

where the subscript "$t$" corresponds to the time (minutes) interval elapsed between the start of formation of the film and the moment at which the measurement is carried out. The film is obtained from the drainage liquid flowing out of a cylinder filled with foam and placed in the center of a Petri dish according to the test described in U.S. Naval Research Laboratory Document AD 435.612. It is also possible to measure the film-forming capacity of solutions over cyclohexane. To accomplish this, the film is obtained by distributing, with the aid of a syringe, 0.1 $cm^3$ of surface-active solution over the entire surface of the hydrocarbon which is placed in a Pyrex cup 145 mm in diameter. The results are expressed in the same way as above. The spreading velocities are evaluated according to the method described in French Pat. No. 2,185,668; a crystallizer 145 mm in diameter is half filled with cyclohexane, and 5 drops (0.1 cc) of a 0.5% aqueous solution — or a solution of another concentration — of the mixture of fluorinated surfactants is deposited in the center of the hydrocarbon surface. The difference in reflecting power makes it possible to follow the progress of the fluorinated film and thus measure the time required for covering the entire surface. With the introduction of aromatic cationic fluorinated surface-active agents it is possible to attain spreading velocities of 165 $cm^2$ per second or more with a 6 $\mu$ thick cover of liquid film over cyclohexane and even over gasoline.

In the present composition, the nonionic fluorinated compound may be replaced by a non-fluorinated nonionic compound; preferably by aromatic hydrocarbon surfactants such as the well-known ethylene oxide-phenol condensation products.

The novel surface-active composition forming the subject of the present invention preferably contains:

about 5 to 55% of the amphoteric surfactant by weight;

about 5 to 45% of the nonionic surfactant by weight; and about 30 to 60% of the cationic surfactant by weight.

It is, of course, understood that these three types of

TABLE I

| Solution A, and | Mixture of | Solution B | | | | |
|---|---|---|---|---|---|---|
| 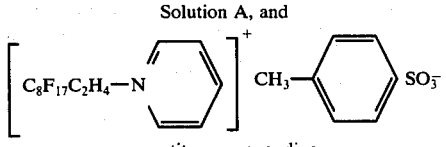 | | $C_8F_{17}C_2H_4CONH-(CH_2)_3-N^+(CH_3)_2CH_2CH_2COO^-$ | | | | |
| quantity corresponding to 0.11% fluorine per liter +0.2% Triton X100* | | quantity corresponding to 0.11% fluorine per liter + 0.2% Triton X100 | velocity of Spreading | | Film-forming capacity on cyclohexane | |
| | | | Cyclohexane | gasoline | $PF_1$ | $PF_{15}$ |
| 100 | | 0 | 1 sec. | 1.5 sec. | 0.65 | 1 |
| 92 | | 8 | 1 sec. | 1.5 sec. | 0.75 | 0.60 |
| 80 | | 20 | 1 sec. | 5 sec. | 0.75 | 0.45 |
| 0 | | 100 | Partial Spreading | Does not spread | 0.69 | 0.84 |

*Triton X100 is $t.C_8H_{17}-C_6H_4-(OC_2H_4)_{g\,10}OH$

The film-forming capacity of the film is characterized by the ratio of the rate of evaporation of the solvent in the presence of the fluorinated film to that of the solvent surfactants correspond to those described above.

On the practical, and above all the economic level, such a surface-active composition is generally used in the form of an aqueous solution. The concentration is not critical; it is essentially a function of the ratio of efficacy to price. An aqueous solution which fulfills these criteria particularly well contains less than 5% — preferably 0.1 to 2% — of the surface-active composition by weight, the remainder preferably being water.

The different components used in the following examples, may be prepared as follows:

The amphoteric fluorinated surface-active agent $C_8F_{17}$— $C_2H_4$— COHN — $(CH_2)_3$ — $N^+(CH_3)_2$ $CH_2$— $CH_2$— $COO^-$ is prepared by methods described in Examples 2 and 6 of French Pat. No. 2,127,287, by adding beta-propiolactone or acrylic acid to the polyfluoroamine $C_8F_{17}C_2H_4CONH$ — $(CH_{23}N(CH_3)_2$.

The amphoteric fluorinated surface-active agent $C_6F_{13}$— $C_2H_4SO_2NH$—$(CH_2)_2$—$N^+(CH_3)_2$ $CH_2$—$CH_2$—$COO^-$ is prepared according to Example 2 of French Patent 2,128,028 by adding beta-propiolactone to the polyfluoroamine $C_6F_{13}C_2H_4SO_2NH(CH_2)_2N(CH_3)_2$, or better, according to the following examples:

In a 1 liter Pyrex reactor equipped with a stirrer are introduced 257 g (0.52 mole) of $C_6F_{13}C_2H_4SO_2NH(CH_2)_2$ $N(CH_3)_2$ dissolved in 700 $cm^3$ of tetrahydrofuran dried on a molecular sieve and 75 g (1.04 moles) of dry and stabilized acrylic acid. The mixture is stirred at room temperature for 32 hours. The amphoteric compound begins to precipitate about 1½ hours after the mixing of the reactants. The white solid obtained in this manner is separated from the reaction medium by filtration through a filter crucible, washed with two 100 cc portions of anhydrous tetrahydrofurn and dried in vacuo. In this way 273 g of the compound $C_6F_{13}C_2H_4SO_2NH$ —$(C_2H_2)_2N^+(CH_3)_2$ $CH_2$—$CH_2$-$COO^-$ are obtained, m.p. 112°; yield 93%.

The compound $C_6F_{13}C_2H_4COO(CH_2$—$CH_2$—$O)_7CH_3$ is obtained in 95% yield by the procedure described in Example 2 of French Pat. No. 2,185,668, through esterification of the acid $C_6F_{13}C_2H_4COOH$ with the polyethoxyalkyl alcohol $HO(CH_2$—$CH_2$—$O)_7CH_3$ sold commercially by Produits Chimiques Ugine Kuhlmann under the name Emkanol M 350.

The compound

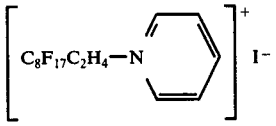

is prepared according to the procedure described in Example 1 of French Pat. No. 1,588,482, by reacting pyridine with the compound $C_8F_{17}C_2H_4I$.

The following substances are then placed in a 10 liter reactor: 6 liters of acetone, 1,959 g (3 moles) of

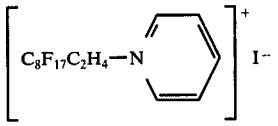

and 608 g (3.2 moles) of -toluenesulfonic acid (monohydrate). The mixture is heated to 45° and the reactor purged of nitrogen. At this temperature the quaternary ammonium salt is completely dissolved. A stream of ethylene oxide is then bubbled into the reaction mixture at the rate of about 2.5 moles per hour, with the temperature allowed to rise to about 50°-55° C. After introducing a slight excess (about 10%) of ethylene oxide, the reaction mixture is stirred at 50° C for 2 hours. The reaction mixture is then distilled at atmospheric pressure, with the elimination of 4 liters of acetone which is replaced with an equal volume of petroleum ether (b.p. 40°-64° C). The compound

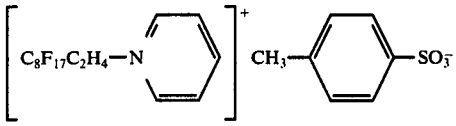

precipitates during the addition of petroleum ether. After cooling to 0° C, the product is filtered at this temperature, and dried in vacuo at room temperature. In this way about 2,030 g of product is obtained as a white powder, yield 97%.

EXAMPLE 1

By way of a comparative test, the mixture described in Example 10 of French Pat. No. 2,185,668 is prepared:

| | |
|---|---|
| $C_8F_{17}C_2H_4CONH(CH_2)_3\overset{+}{N}(CH_3)_2CH_2$—$CH_2$—$COO^-$ | : 62% by weight |
| $C_6F_{13}C_2H_4COO(CH_2$—$CH_2$—$O)_7$ $CH_3$ | : 30% by weight |
| $C_6F_{13}C_2H_4COO^{--}$ $\overset{+}{N}H_3(CH_2)_3$ $\overset{+}{N}(CH_3)_2$— $CH_2$—$CH_2$—$COO^-$ | : 8% by weight. |

A 0.5% aqueous solution shows the following properties:

| | | | |
|---|---|---|---|
| Foaming power: | 450 $cm^3$ | | |
| pH: | 4.05 | | |
| Dynamic viscosity: | 10.2 mPo | | |
| Spreading velocity on cyclohexane: | 4 sec. | | |
| Spreading velocity on premium gasoline: | Partial Spreading | | |
| Film-forming capacity: | PF 1 min. | PF 10 min. | PF 15 min. |
| of the foam on premium gasoline: | 0.28 | 0.29 | 0.30 |
| of the solution on cyclohexane: | 0.18 | 0.37 | 0.45 |

EXAMPLE 2

By way of a second comparative test, a concentrate for "light water" known under the tradename FC 196 and sold by 3M Company as a fire-extinguishing agent, is diluted with water until obtaining a fluorine concentration of 0.22%.

This solution shows the following properties:

| | | | |
|---|---|---|---|
| Spreading velocity on cyclohexane: | 1 second | | |
| Spreading velocity on gasoline: | 2 seconds | | |
| Film-forming capacity: | PF 1 min. | PF 10 min. | PF 15 min. |
| of the foam on premium gasoline: | 0.37 | 0.43 | 0.46 |
| of the solution on cyclohexane: | 0.35 | 0.75 | 0.83 |
| Drainage time: | | 2 min. 40 sec. | |

EXAMPLE 3

The following three-component mixture is prepared:

| | |
|---|---|
| $C_6F_{13}C_2H_4SO_2NH-(CH_2)_2\overset{+}{N}(CH_3)_2-CH_2-CH_2-COO^-$ | : 36% by weight |
| $C_6F_{13}CH_2-CH_2-O-(CH_2-CH_2-O)_{12}H$ | : 10% by weight |
| 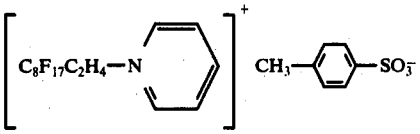 | : 54% by weight. |

From this mixture an aqueous solution is prepared containing 0.22% fluorine as well as 0.3% isopropyl alcohol.

This solution has the following properties:

| | | | |
|---|---|---|---|
| Foaming power: | 650 cc | | |
| pH: | 5.15 | | |
| Dynamic viscosity at 25° C: | 10.15 mPo | | |
| Spreading velocity on cyclohexane: | 1.5 sec. | | |
| Spreading velocity on gasoline: | 3 sec. | | |
| Film-forming capacity: | PF 1 min. | PF 10 min. | PF 15 min. |
| of the foam on premium gasoline: | 0.22 | 0.33 | 0.33 |
| of the solution on cyclohexane: | 0.49 | 0.72 | 0.56 |
| Drainage time: | | 5 min. | |

EXAMPLE 4

A 0.5% aqueous solution of the following mixture in water (containing 0.22% fluorine):

| | |
|---|---|
| $C_6F_{13}C_2H_4SO_2NH-(CH_2)_3\overset{+}{N}(CH_3)_2-CH_2-CH_2-COO^-$ | :36.5% by weight |
| $C_6F_{13}CH_2-CH_2-O(CH_2-CH_2)_{12}H$ | : 10% by weight |
| 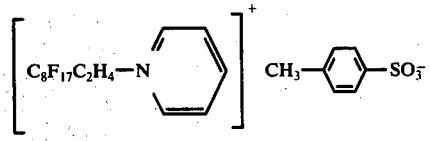 | :53.5% by weight |

has the following properties:

| | | | |
|---|---|---|---|
| Foaming power: | 350 cc | | |
| pH: | 4.0 | | |
| Dynamic viscosity at 25° C: | 11.15 mPo | | |
| Spreading velocity on cyclohexane: | <1 sec. | | |
| Spreading velocity on gasoline: | 1.5 sec. | | |
| Film-forming capacity: | PF 1 min. | PF 10 min. | PF 15 min. |
| of foam on premium gasoline: | 0.34 | 0.34 | 0.32 |
| of the solution on cyclohexane: | 0.60 | 0.42 | 0.30 |
| Drainage time: | | 4 min. 15 sec. | |

EXAMPLE 5

The following mixture is prepared in water:

| | |
|---|---|
| $C_8F_{17}-C_2H_4CO-NH-(CH_2)_3\overset{+}{N}(CH_3)_2-CH_2-CH_2-COO$ | : 10% by weight |
| Secopal OP 9 | : 45% by weight |

-continued

| | |
|---|---|
| 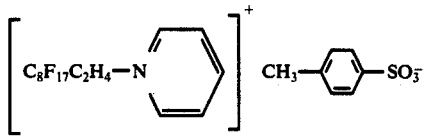 | : 45% by weight |

Secopal OP 9 is a nonionic surface-active agent having the formula

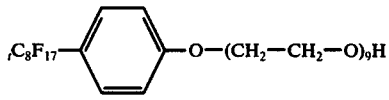

and manufactured by the SINNOVA Company.

An aqueous solution of this mixture containing 0.22% fluorine has the following properties:

| | | | |
|---|---|---|---|
| Spreading velocity on cyclohexane: | 1 sec. | | |
| Spreading velocity on gasoline: | 1.5 sec. | | |
| Film-forming capacity: | PF 1 min. | PF 10 min. | PF 15 min. |
| of the solution on cyclohexane: | 0.75 | 0.58 | 0.45 |

EXAMPLE 6

The following mixture is prepared in water:

| | |
|---|---|
| $C_8F_{17}C_2H_4CONH-(CH_2)_3\overset{+}{N}(CH_3)_2-CH_2-CH_2-COO^-$ | : 55% by weight |
| Secopal OP 9 | : 5% by weight |
| 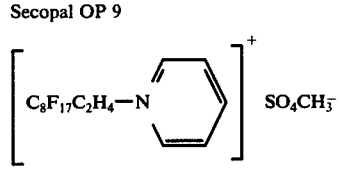 | : 40% by weight |

The properties of an aqueous solution containing 0.22% fluorine are as follows:

| | | | |
|---|---|---|---|
| Spreading velocity on cyclohexane: | 1 sec. | | |
| Spreading velocity on gasoline: | 2 sec. | | |
| Film-forming capacity: | PF 1 min. | PF 10 min. | PF 15 min. |
| of the foam on premium gasoline: | 0.50 | 0.41 | 0.35 |
| of the solution on cyclohexane: | 0.60 | 0.45 | 0.48 |

EXAMPLE 7

The following mixture is prepared in water:

| | |
|---|---|
| $C_6F_{13}C_2H_4SO_2\underset{\underset{CH_3}{\vert}}{N}-(CH_2)_2\overset{+}{N}(CH_3)_2-CH_2-CH_2-COO^-$ | : 30% by weight |
| $C_6F_{13}-C_2H_4COO-(CH_2-CH_2-O)_7CH_3$ | : 20% by weight |

-continued

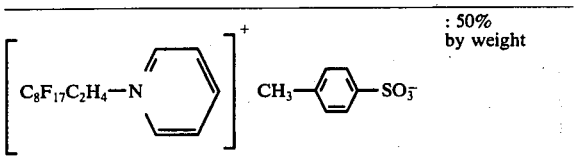

: 50% by weight

The properties of an aqueous solution containing 0.22% fluorine are as follows:

| | | | |
|---|---|---|---|
| Spreading velocity on cyclohexane: | | <1 sec. | |
| Spreading velocity on gasoline: | | 1.5 sec. | |
| Film-forming capacity: | PF 1 min. | PF 10 min. | PF 15 min. |
| of the foam on premium gasoline: | 0.60 | 0.47 | 0.40 |
| of the solution on cyclohexane: | 0.50 | 0.39 | 0.36 |

We claim:

1. An aqueous fire-extinguishing composition comprising an aqueous solution of a mixture of (a) from about 5 to 45 percent of a nonionic surface-active agent, (b) from about 5 to 55 percent of a fluorinated amphoteric surface active agent, and (c) from about 30 to 60 percent of a cationic aromatic fluorinated surface-active agent of formula

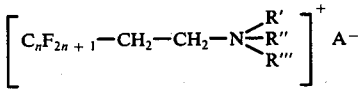

in which; $C_nF_{2n+1}$ represents a straight or branched perfluoro chain were $n$ is a whole number between 1 and about 20; A is an anion; R', R'' and R''' are defined as follows:

1. R' and R'' may be identical or different, and are alkyl radicals containing 1 to 8 carbon atoms, and wherein R''' is an aryl radical or an arylalkyl radical containing 1 to 8 carbon atoms in the alkyl chain, or the aromatic derivative of a hydroxyalkyl radical containing between 1 and about 8 carbon atoms;
2. R' is an alkyl radical containing 1 to 8 carbon atoms, and R'' and R''' together constitute a divalent radical linked to the nitrogen atom by two single bonds derived from alkyl, alkenyl or dienic groups containing 4 to 9 atoms and carrying or containing aromatic substituents or radical;
3. R', R'' and R''' together constitute the residual part of a tertiary aromatic amine derived from pyridine or pyridine derivatives and containing 5 to 18 carbon atoms.

2. The composition of claim 1 in which the nonionic surface-active agent is a fluorinated nonionic surface-active agent.

3. The composition of claim 1 in which the composition contains less than about 5 percent of the total composition of the mixture of agents (a), (b) and (c).

4. The composition of claim 3 in which the composition contains from 0.5 to 2 percent by weight of the total composition of the mixture of agents (a), (b) and (c).

5. An aqueous surface-active composition having a high spreading velocity on hydrocarbons, comprising an aqueous solution of a. from about 5 to 55 percent of a fluorinated amphoteric surface-active compound of formula

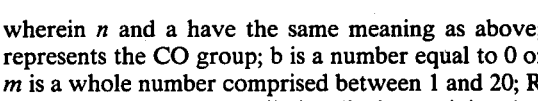

wherein $n$ is a whole number comprised between 1 and 20; a is a number comprised between 2 and 10; X is a functional group CO or $SO_2$; $R_1$ is a hydrogen atom or an alkyl radical containing 1 to 6 carbon atoms; $R_2$ and $R_3$ are alkyl radicals containing 1 to 3 carbon atoms, at least one of these radicals being methyl; p and q are numbers comprised between 1 and 10;

b. from about 5 to 45 percent of a nonionic surfaceactive compound

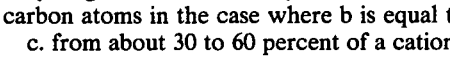

wherein $n$ and a have the same meaning as above; Y represents the CO group; b is a number equal to 0 or 1; $m$ is a whole number comprised between 1 and 20; $R_4$ is a hydrogen atom or an alkyl radical containing 1 to 6 carbon atoms in the case where b is equal to 1; and c. from about 30 to 60 percent of a cationic aromatic fluorinated surface-active agent of formula

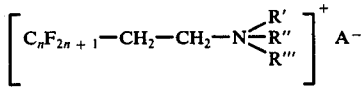

in which; $C_nF_{2n+1}$ represents a straight or branched perfluoro chain where $n$ is a whole number between 1 and about 20; A is an anion; R', R'' and R''' are defined as follows:

1. R' and R'' may be identical or different, and are alkyl radicals containing 1 to 8 carbon atoms, and wherein R''' is an aryl radical or an arylalkyl radical containing 1 to 8 carbon atoms in the alkyl chain, or the aromatic derivative of a hydroxyalkyl radical containing between 1 and about 8 carbon atoms; 2. R' is an alkyl radical containing 1 to 8 carbon atoms, and R'' and R''' together constitute a divalent radical linked to the nitrogen atom by two single bonds derived from alkyl, alkenyl or dienic groups containing 4 to 9 atoms and carrying or containing aromatic substituents or radicals;
3. R', R'' and R''' together constitute the residual part of a tertiary aromatic amine derived from pyridine or pyridine derivatives and containing 5 to 18 carbon atoms.

6. Composition according to claim 5 wherein the residual part of the tertiary aromatic amine is derived from $C_5H_5$ (pyridine), $C_9H_7$ (quinoline and isoquiniline), $C_6H_8$ (picolines) or $C_{13}H_9$ (acridine).

7. Composition according to claim 5 wherein the cationic aromatic fluorinated surface-active agent has the formula

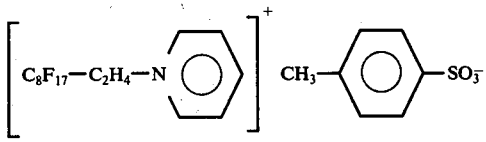

8. A fire extinguishing surface-active composition comprising the combination of a. from about 5 to 55 percent of a fluorinated amphoteric surface-active compound of formula $$C_nF_{2n+1}-(CH_2)_a-X-\underset{\underset{R_1}{|}}{N}-(CH_2)_p\overset{+}{N}R_2R_3-(CH_2)_q-COO^-$$

wherein $n$ is a whole number comprised between 1 and 20; $a$ is a number comprised between 2 and 10; X is a functional group CO or $SO_2$; $R_1$ is a hydrogen atom or an alkyl radical containing 1 to 6 carbon atoms; $R_2$ and $R_3$ are alkyl radicals containing 1 to 3 carbon atoms, at least one of these radicals being methyl; $p$ and i q are numbers comprised between 1 and 10;

b. from about 5 to 45 percent of a nonionic surface-active compound $$C_nF_{2n+1}-(CH_2)_a-(Y)_b-(O-C_2H_4)_m OR_4$$

wherein $n$ and $a$ have the same meaning as above; Y represents the CO group; $b$ is a number equal to 0 or 1; $m$ is a whole number comprised between 1 and 20; $R_4$ is a hydrogen atom or an alkyl radical containing 1 to 6 carbon atoms in the case where $b$ is equal to 1; and c. from about 30 to 60 percent of a cationic aromatic fluorinated surface-active agent of formula $$\left[C_nF_{2n+1}-CH_2-CH_2-N\begin{matrix}R'\\R''\\R'''\end{matrix}\right]^+ A^-$$

in which; $C_nF_{2n+1}$ represents a straight or branched perfluoro chain where $n$ is a whole number between 1 and about 20; A is an anion; R', R'' and R''' are defined as follows:

1. R' and R'' may be identified or different, and are alkyl radicals containing 1 to 8 carbon atoms, and wherein R''' is an aryl radical or an arylalkyl radical containing 1 to 8 carbon atoms in the alkyl chain, or the aromatic derivative of a hydroxyalkyl radical containing between 1 and about 8 carbon atoms;
2. R' is an alkyl radical containing 1 to 8 carbon atoms, and R'' and R''' together constitute a divalent radical linked to the nitrogen atom by two single bonds derived from alkyl, alkenyl or dienic groups containing 4 to 9 atoms and carrying or containing aromatic substituents or radicals;
3. R', R'' and R''' together constitute the residual part of a tertiary aromatic amine derived from pyridine or pyridine derivatives and containing 5 to 18 carbon atoms.

9. Composition according to claim 8 wherein the nonionic fluorinated surface-active compound is replaced by a nonionic, non-fluorinated aromatic surface-active compound.

10. Composition according to claim 8 wherein the amphoteric compound is the derivative $$C_6F_{13}C_2H_4SO_2NH-(CH_2)_3N^+(CH_3)_2-CH_2-CH_2-COO^-$$

the nonionic compound is the derivative $$C_6F_{13}C_2H_4-O(C_2H_4O)_{12}H$$

and the cationic compound is the derivative

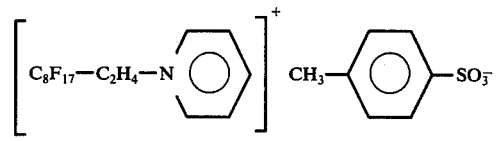

11. The method of extinguishing fires which comprises subjecting a fire to a composition comprising the combination of a. from about 5 to 55 percent of a fluorinated amphoteric surface-active compound of formula $$C_nF_{2n+1}-(CH_2)_a-X-\underset{\underset{R_1}{|}}{N}-(CH_2)_p\overset{+}{N}R_2R_3-(CH_2)_q-COO^-$$

wherein $n$ is a whole number comprised between 1 and 20; $a$ is a number comprised between 2 and 10; X is a functional group CO or or $SO_2$; $R_1$ is a hydrogen atom or an alkyl radical containing 1 to 6 carbon atoms; $R_2$ and $R_3$ are alkyl radicals containing 1 to 3 carbon atoms, at least one of these radicals being methyl; $p$ and $q$ are numbers comprised between 1 and 10;

b. from about 5 to 45 percent of a nonionic surface-active compound $$C_nF_{2n+1}-(CH_2)_a-(Y)_b-(O-C_2H_4)_m OR_4$$

wherein $n$ and $a$ have the same meaning as above; Y represents the CO group; $b$ is a number equal to 0 or 1; $m$ is a whole number comprised between 1 and 20; $R_4$ is a hydrogen atom or an alkyl radical containing 1 to 6 carbon atoms in the case where $b$ is equal to 1; and c. from about 30 to 60 percent of a cationic aromatic fluorinated surface-active agent of formula $$\left[C_nF_{2n+1}-CH_2-CH_2-N\begin{matrix}R'\\R''\\R'''\end{matrix}\right]^+ A^-$$

in which; $C_nF_{2n+1}$ represents a straight or branched perfluoro chain where $n$ is a whole number between 1 and about 20; A is an anion; R', R'' and R''' are defined as follows:

1. R' and R'' may be identical or different, and are alkyl radicals containing 1 to 8 carbon atoms, and wherein R''' is an aryl radical or an arylalkyl radical containing 1 to 8 carbon atoms in the alkyl chain, or the aromatic derivative of a hydroxyalkyl radical containing between 1 and about 8 carbon atoms;
2. R' is an alkyl radical containing 1 to 8 carbon atoms, and R'' and R''' together constitute a divalent radical linked to the nitrogen atom by two single bonds derived from alkyl, alkenyl or dienic groups containing 4 to 9 atoms and carrying or containing aromatic substituents or radicals;
3. R', R'' and R''' together constitute the residual part of a tertiary aromatic amine derived from pyridine or pyridine derivatives and containing 5 to 18 carbon atoms.

12. The method of forming fluorinated films impermeable to hydrocarbon vapors and simultaneously exhibiting a high spreading velocity and high resistance to mechanical stresses comprising applying on a liquid hydrocarbon surface a surface-active composition comprising the combination of three fluorinated surface-active agents;

a. a fluorinated amphoteric surface-active compound of formula $$C_nF_{2n+1}-(CH_2)_a-X-\underset{\underset{R_1}{|}}{N}-(CH_2)_p\overset{+}{N}R_2R_3-(CH_2)_q-COO^-$$

wherein $n$ is a whole number comprised between 1 and 20; $a$ is number comprised between 2 and 10; X is a functional group CO or $SO_2$; $R_1$ is a hydrogen atom or an alkyl radical containing 1 to 3 carbon atoms, $R_2$ and $R_3$ are alkyl radicals containing 1 to 3 carbon atoms, at least one of these radicals being methyl; $p$ and $q$ are numbers comprised between 1 and 10;

b. a nonionic surface-active compound $$C_nF_{2n+1}-(CH_2)_a-(Y)_b-(O-C_2H_4)_m OR_4$$

wherein $n$ and $a$ have the same meaning as above; Y represents the CO group; $b$ is a number equal to 0 or 1; $m$ is a whole number comprised between 1 and 20; $R_4$ is a hydrogen atom or an alkyl radical containing 1 to 6 carbon atoms in the case where $b$ is equal to 1; and contains a cationic aromatic fluorinated surface-active agent of formula $$\left[C_nF_{2n+1}-CH_2-CH_2-N\begin{matrix}R'\\R''\\R'''\end{matrix}\right]^+ A^-$$

in which; $C_nF_{2n+1}$ represents a straight or branched perfluoro chain where $n$ is a whole number between 1 and about 20; A is an anion; R′, R″ and R‴, are defined as follows:

1. R′ and R″ may be identical or different, and are alkyl radicals containing 1 to 8 carbon atoms, and wherein R‴ is an aryl radical or an arylalkyl radical containing 1 to 8 carbon atoms in the alkyl chain, or the aromatic derivative of a hydroxyalkyl radical containing between 1 and about 8 carbon atoms;
2. R′ is an alkyl radical containing 1 to 8 carbon atoms, and R″ and R‴ together constitute a divalent radical linked to the nitrogen atom by two single bonds derived from alkyl, alkenyl or dienic groups containing 4 to 9 atoms and carrying or containing aromatic substituents or radical;
3. R′, R″ and R‴ together constitute the residual part of a tertiary aromatic amine derived from pyridine or pyridine derivatives and containing 5 to 18 carbon atoms.

* * * * *

UNITED STATES PATENT AND TRADEMARK OFFICE

CERTIFICATE OF CORRECTION

PATENT NO. : 4,069,158

DATED : January 17, 1978

INVENTOR(S) : Rene Bertocchio and Louis Foulletier

It is certified that error appears in the above-identified patent and that said Letters Patent are hereby corrected as shown below:

Column 1, line 19, reads "$N^{30}$", should read --$\overset{+}{N}$--

Column 5, last line of Table I, reads "$(OC_2H_4)_{g-10}OH$"
should read --$(OC_2H_4)_{9-10}OH$--

Column 7, line 9, reads "COHN", should be --CONH--

Column 11, line 36, reads "were", should read --where--

Column 13, line 15, reads "p and i q", should read --p and q--

Column 15, line 18, reads "1 to 3" should read --1 to 6--

Signed and Sealed this

Sixteenth Day of May 1978

[SEAL]

Attest:

RUTH C. MASON
Attesting Officer

LUTRELLE F. PARKER
Acting Commissioner of Patents and Trademarks